US010873151B2

(12) United States Patent
Zen

(10) Patent No.: US 10,873,151 B2
(45) Date of Patent: Dec. 22, 2020

(54) ELECTRICAL CONNECTION DEVICE WITH SEAL BETWEEN A PROTECTION DEVICE AND A CONNECTOR

(71) Applicant: TE Connectivity Italia Distribution S.r.l., Turin (IT)

(72) Inventor: Gianluca Zen, Bruino (IT)

(73) Assignee: TE Connectivity Italia Distribution S.r.l., Turin (IT)

( * ) Notice: Subject to any disclaimer, the term of this patent is extended or adjusted under 35 U.S.C. 154(b) by 0 days.

(21) Appl. No.: 16/276,130

(22) Filed: Feb. 14, 2019

(65) Prior Publication Data

US 2019/0252823 A1 Aug. 15, 2019

(30) Foreign Application Priority Data

Feb. 14, 2018 (IT) ..... 102018000002675

(51) Int. Cl.

| | |
|---|---|
| ***H01R 13/52*** | (2006.01) |
| ***H01R 43/00*** | (2006.01) |
| *H01R 13/516* | (2006.01) |
| *H01R 107/00* | (2006.01) |
| *H01R 13/523* | (2006.01) |

(52) U.S. Cl.

CPC ..... *H01R 13/5205* (2013.01); *H01R 13/5219* (2013.01); *H01R 43/005* (2013.01); *H01R 13/516* (2013.01); *H01R 13/521* (2013.01); *H01R 13/5202* (2013.01); *H01R 13/523* (2013.01); *H01R 2107/00* (2013.01)

(58) Field of Classification Search

CPC ..... H01R 13/5219; H01R 13/5202; H01R 13/5205; H01R 13/521; H01R 43/005; H01R 13/523

USPC ..... 439/271, 274, 275, 466, 694, 372

See application file for complete search history.

(56) References Cited

U.S. PATENT DOCUMENTS

| | | | | |
|---|---|---|---|---|
| 7,011,539 | B1 | 3/2006 | Nagy et al. | |
| 9,293,856 | B2 | 3/2016 | Shigeta et al. | |
| 2003/0109166 | A1* | 6/2003 | Ookura | H01R 13/74 439/372 |

(Continued)

FOREIGN PATENT DOCUMENTS

| | | |
|---|---|---|
| CN | 205172180 U | 4/2016 |
| DE | 8026598.1 U1 | 3/1981 |

(Continued)

OTHER PUBLICATIONS

Italian Written Opinion and Search Report, dated Sep. 13, 2018, 9 pages.

(Continued)

*Primary Examiner* — Abdullah A Riyami
*Assistant Examiner* — Justin M Kratt
(74) *Attorney, Agent, or Firm* — Barley Snyder

(57) ABSTRACT

A connection device comprises a protection device configured to protect a cable, a connector configured to electrically connect the connection device to an external electrical connection, and a seal connecting the protection device to the connector. The seal includes a first sealing element mechanically connected to the protection device and a second sealing element mechanically connected to the connector. The first sealing element engages the second sealing element to connect the protection device to the connector.

20 Claims, 6 Drawing Sheets

(56) References Cited

U.S. PATENT DOCUMENTS

| | | | |
|---|---|---|---|
| 2014/0017073 | A1 | 1/2014 | Muizelaar et al. |
| 2014/0265762 | A1 | 9/2014 | Murphy et al. |
| 2017/0113853 | A1 | 4/2017 | Cahoon et al. |
| 2017/0222356 | A1 | 8/2017 | Hashimoto et al. |

FOREIGN PATENT DOCUMENTS

| | | | |
|---|---|---|---|
| DE | 102004057860 | A1 | 10/2005 |
| DE | 202006013243 | U1 | 10/2006 |
| DE | 112013005411 | T5 | 7/2015 |
| DE | 112014003303 | T5 | 3/2016 |
| EP | 0440417 | A1 | 1/1991 |
| EP | 1318570 | A1 | 6/2003 |
| WO | 2015008198 | A1 | 1/2015 |

OTHER PUBLICATIONS

Abstract of CN205172180U, dated Apr. 20, 2016, 2 pages.
Abstract of corresponding document EP1583251 related to DE102004057860, dated Oct. 27, 2005, 1 page.
French Search Report, dated Sep. 28, 2020, 5 pages.
Abstract of DE 202006013243, dated Oct. 26, 2006, 1 page.

* cited by examiner

ELECTRICAL CONNECTION DEVICE WITH SEAL BETWEEN A PROTECTION DEVICE AND A CONNECTOR

CROSS-REFERENCE TO RELATED APPLICATION

This application claims the benefit of the filing date under 35 U.S.C. § 119(a)-(d) of Italian Patent Application No. 102018000002675, filed on Feb. 14, 2018.

FIELD OF THE INVENTION

The present invention relates to an electrical connection device and, more particularly, to an electrical connection device having a protection device.

BACKGROUND

Electrical connectors are used to connect one or more cable terminals of one or more cables to an electrical device. The electrical devices are used in various applications, such as in automotive and industrial applications. The connection of the cables to the electrical device must be isolated from an external environment, as such connections are frequently made in outdoor environments where atmospheric agents such as rain, wind or large temperature changes can strongly affect the connections.

A connection device connected to the electrical device and the terminals of the cables may form a socket through which the cables entering a first side are coupled to the electrical device located on an opposite second side. The connection device generally includes a protection device configured to house and protect the cables and a connector configured to electrically connect to an external electrical connection.

The protection device is connected to the connector to form the connection device. Connection of such elements is usually very difficult, however, because it is not only necessary to connect the two elements but also to isolate the cables contained within the connection device from the exterior. The protection device and the connector must be connected in such a way that external agents cannot affect the cables, and in particular their terminals, contained within the connection device.

SUMMARY

A connection device comprises a protection device configured to protect a cable, a connector configured to electrically connect the connection device to an external electrical connection, and a seal connecting the protection device to the connector. The seal includes a first sealing element mechanically connected to the protection device and a second sealing element mechanically connected to the connector. The first sealing element engages the second sealing element to connect the protection device to the connector.

BRIEF DESCRIPTION OF THE DRAWINGS

The invention will now be described by way of example with reference to the accompanying Figures, of which.

DETAILED DESCRIPTION OF THE EMBODIMENT(S)

The present invention is described below with reference to particular embodiments, as illustrated in the appended drawings. The present invention, however, is not limited to the particular embodiments described in the following description and detailed and illustrated in the figures, but rather the embodiments described simply provide examples of various aspects of the present invention. Further modifications and variations within the scope of the present invention will be clear to those skilled in the art.

Figure 1:
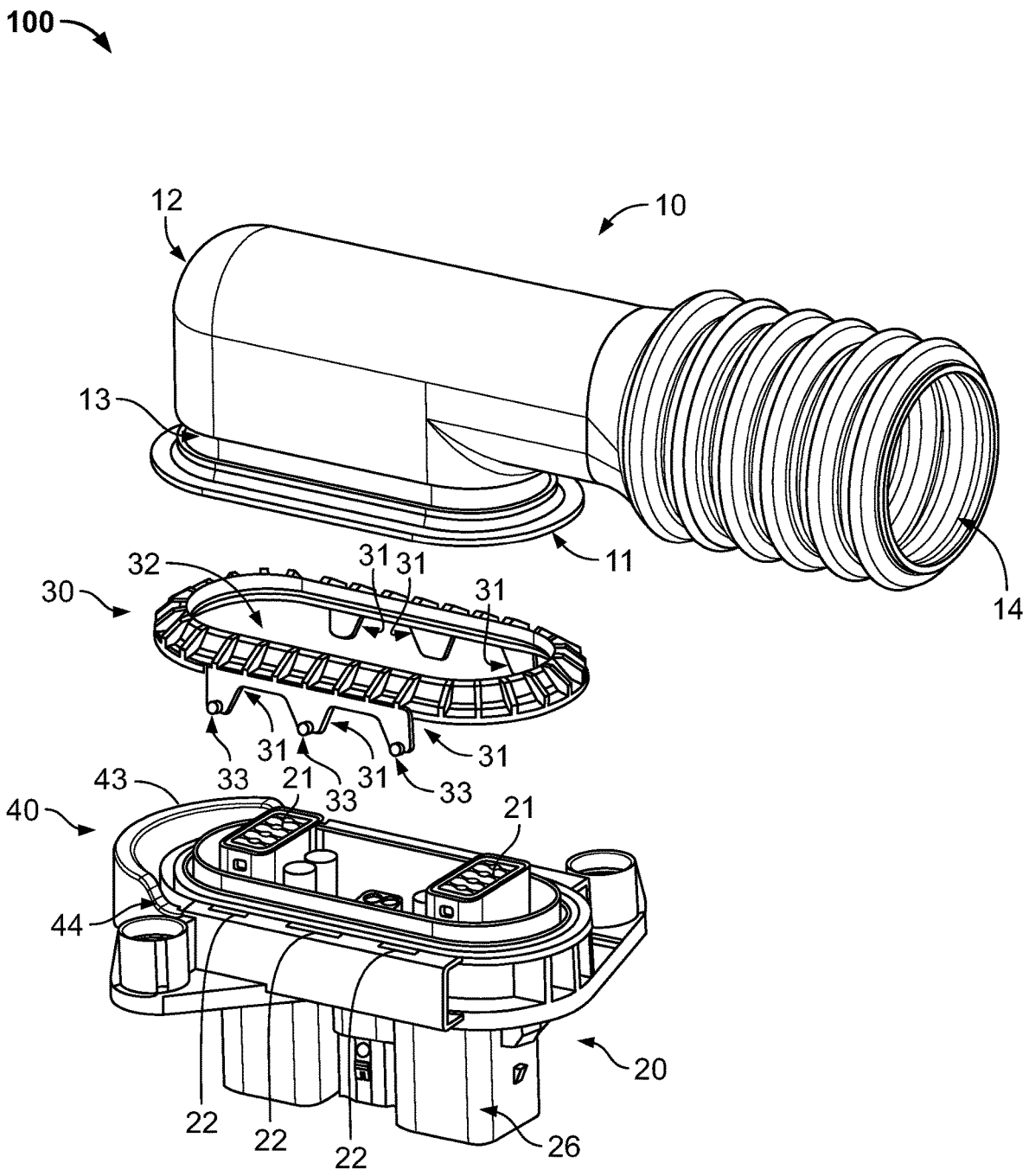
FIG. 1 is an exploded perspective view of a connection device according to an embodiment.

A connection device 100 according to an embodiment, as shown in FIG. 1, comprises a protection device 10, a connector 20, and a seal including a first sealing element 30 and a second sealing element 40.

The protection device 10, as shown in FIG. 1, includes a sheath 10 having an opening 14 into which one or more cables with one or more terminals at their ends can be inserted. The protection device 10 is configured to protect the one or more cables. In an embodiment, the sheath 10 is made of rubber. The rubber construction allows the sheath 10 to be elastically deformed when, as described in greater detail below, the sheath 10 is mechanically connected to an external element.

As shown in FIG. 1, an opening is located at an entry section 14 of the protection device 10. The entry section 14 is connected to an exit section 12, which has an opening. A plurality of cables and their terminals entering sheath 10 at entry section 14 can be drawn out of sheath 10 at exit section 12. The exit section 12 has a flange 11 located at the exit from the sheath 10. The flange 11 has a constant thickness along the entire circumference of the exit section 12. A groove 13 located higher than flange 11 is formed along the entire circumference of the lateral wall of sheath 10.

The first sealing element 30, as shown in FIG. 1, is positioned directly beneath the sheath 10. The first sealing element 30 has an opening 32 with an analogous shape to flange 11. In the embodiment shown in FIG. 1, the flange 11 and the opening 32 of first sealing element 30 have an elongated oval shape in which there are two parallel sides connected to each other by two arcs of circumference at the two opposite ends of the two sides.

A plurality of projections 31 are positioned on each of the two sides of the first sealing element 30 that are parallel to each other. In the embodiment shown in FIG. 1, there are three projections 31 positioned on one side and three projections 31 positioned on the opposite side. The projections 31 are located along an external side of first sealing element 30; on the opposite side to which opening 32 of first sealing element 30 is positioned. Each of the projections 31 has a terminal part with a lug 33 that projects even further externally than projections 31. The projections 31 extend below the first sealing element 30 so that the projections 31 can be inserted into and contact connector 20 as described below.

In the embodiment shown in FIG. 1, the connector 20 is a male connector. The connector 20 comprises a pair of sockets 21 located at the top of connector 20. The sockets 21 connect cable terminals inserted into opening 14 of sheath 10 with the connector 20. The sockets 21 are located on an upper surface of connector 20 in a central part thereof. As shown in FIG. 5C, the connector 20 has at least one upper surface 25 surrounding the two sockets 21 and having a shape similar to that of first sealing element 30. In various embodiments, the upper surface 25 may be either flat or have ridges or be partly flat and have ridges. The upper surface 25 is configured in such a way that the first sealing element 30 is positioned above it. The connector 20 has upper grooves 22 configured to accommodate projections 31 of the first sealing element 30.

The flange 11 of sheath 10 is in direct contact with upper surface 25 of connector 20 and first sealing element 30, and exerts a pressure against the upper surface 25. If the upper surface 25 has ridges, a lower surface of the flange 11 has ridges corresponding to the ridges of upper surface 25 so as to engage upper surface 25 with flange 11.

The connector 20, as shown in FIG. 1, has a socket 26. In the shown embodiment, the socket 26 is a male socket, but may be a female socket in other embodiments. The socket 26 is configured to be electrically connected to an external electrical connection, which will, for example, be connected to an electrical device comprising a socket of the male/female type depending on whether socket 26 is of the male/female type.

The second sealing element 40, as shown in FIG. 1, can be mechanically coupled to the connector 20. The connector 20 includes a pair of lateral grooves 23, shown in FIGS. 4A and 4B, located along two opposite sides of the connector 20. The second sealing element 40 comprises a main central body 43 to which two lateral bodies 44 are connected in an integral manner and are positioned along two opposite ends with respect to main body 43. The lateral bodies 44 are inserted into lateral grooves 23. The main body 43 is arc-shaped so that it can contact the arched outer surface of connector 20.

Figure 4A:
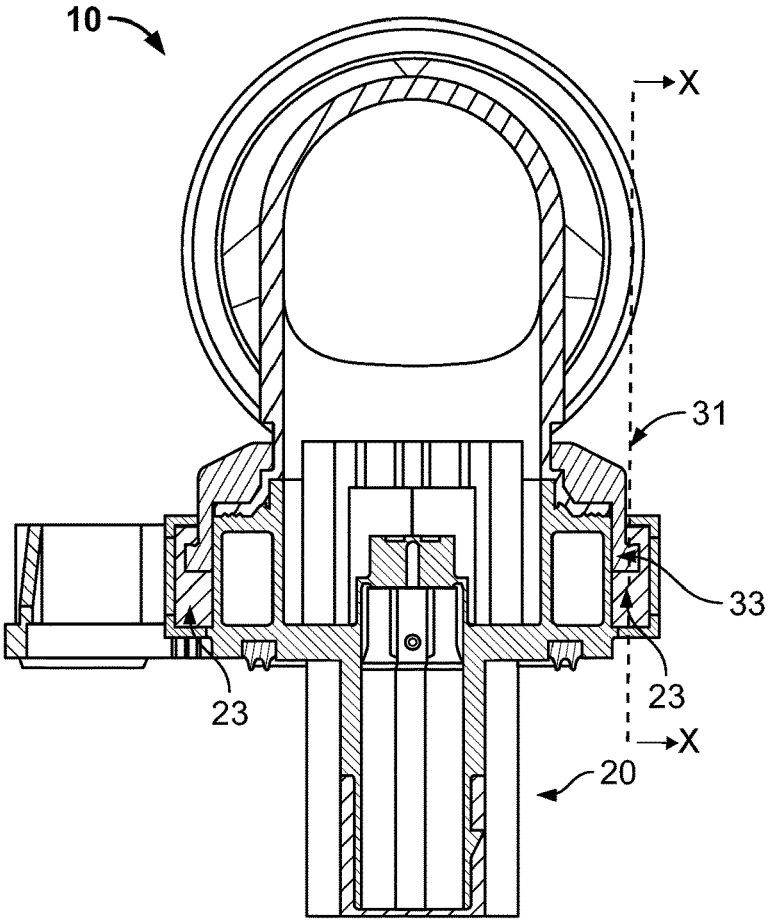
FIG. 4A is a sectional end view of the connection device in the initial state shown in FIG. 3.
Figure 4B:
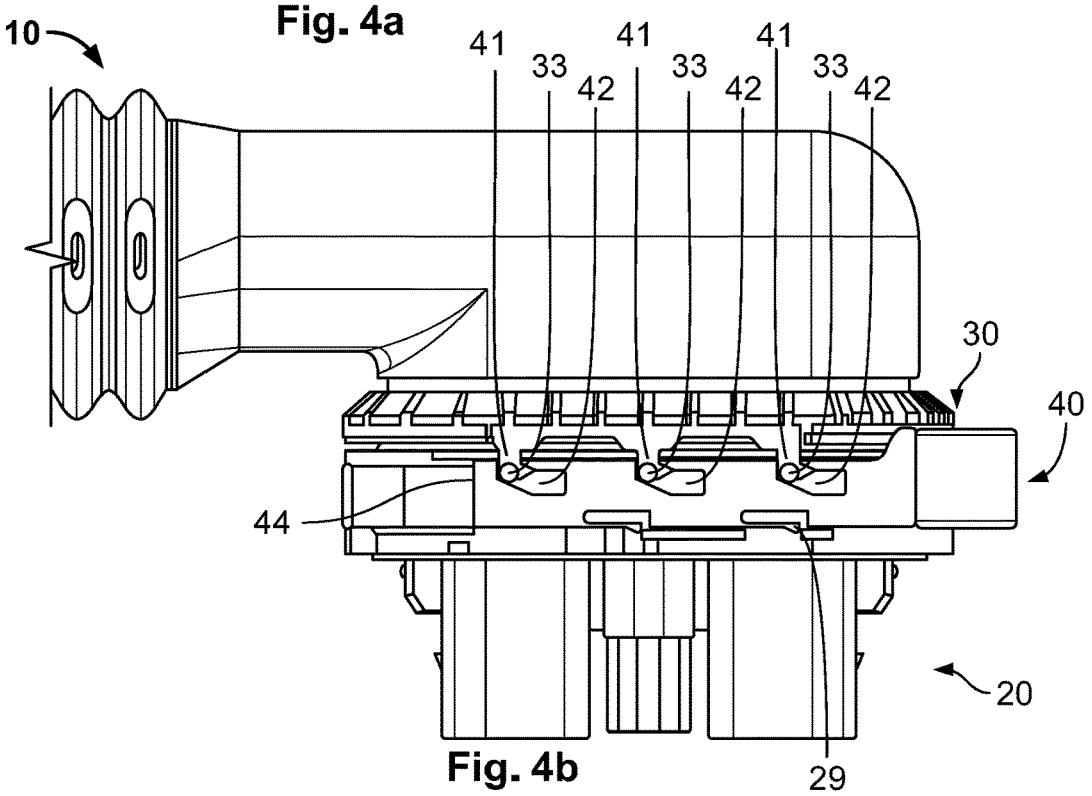
FIG. 4B is a sectional side view of the plane along the line X-X" in FIG. 4A, depicting the connection device in the initial state shown in FIG. 3.

As shown in FIG. 4B, the second sealing element 40 has a plurality of housings 41 within which the lugs 33 of first sealing element 30 can be inserted. Each of the housings 41 is connected to an assembly slot 42 which extends both horizontally and vertically. The lug 33 of projections 31 can be displaced both horizontally and vertically. Vertical displacement enables lug 33 to leave the housing 41, preventing the risk of escaping from second sealing element 40. The horizontal extension of assembly slot 42 allows the first sealing element 30 to exert pressure on the elements below.

A method of connecting the protection device 10 to the connector 20 will now be described in greater detail with reference to FIGS. 2-6.

Figure 2:
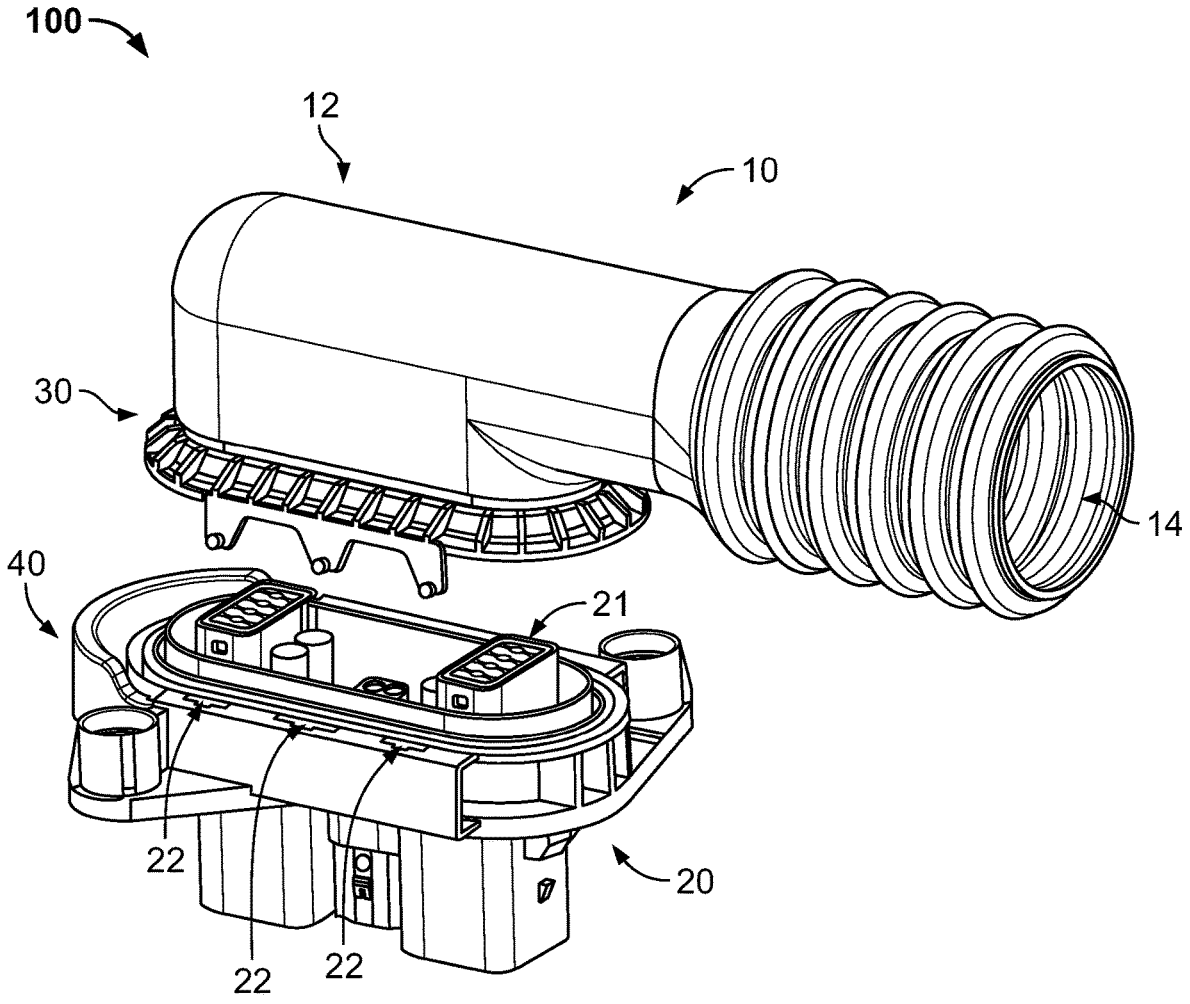
FIG. 2 is a perspective view of the connection device with a first sealing element mechanically coupled to a protection device and a second sealing element mechanically coupled to a connector.

As shown in FIG. 2, the first sealing element 30 is mechanically connected to the sheath 10. In an embodiment, the sheath 10 is made of elastic material, such as rubber. By holding the first sealing element 30, which is made of plastic material in an embodiment, and applying a force to the sheath 10, which is made of an elastic material, the flange 11 is inserted into opening 32. The inner wall of opening 32 of the first sealing element 30 rests on the groove 13 in sealing element 30, ensuring that the flange 11 acts as a lower support for the first sealing element 30.

Figure 3:
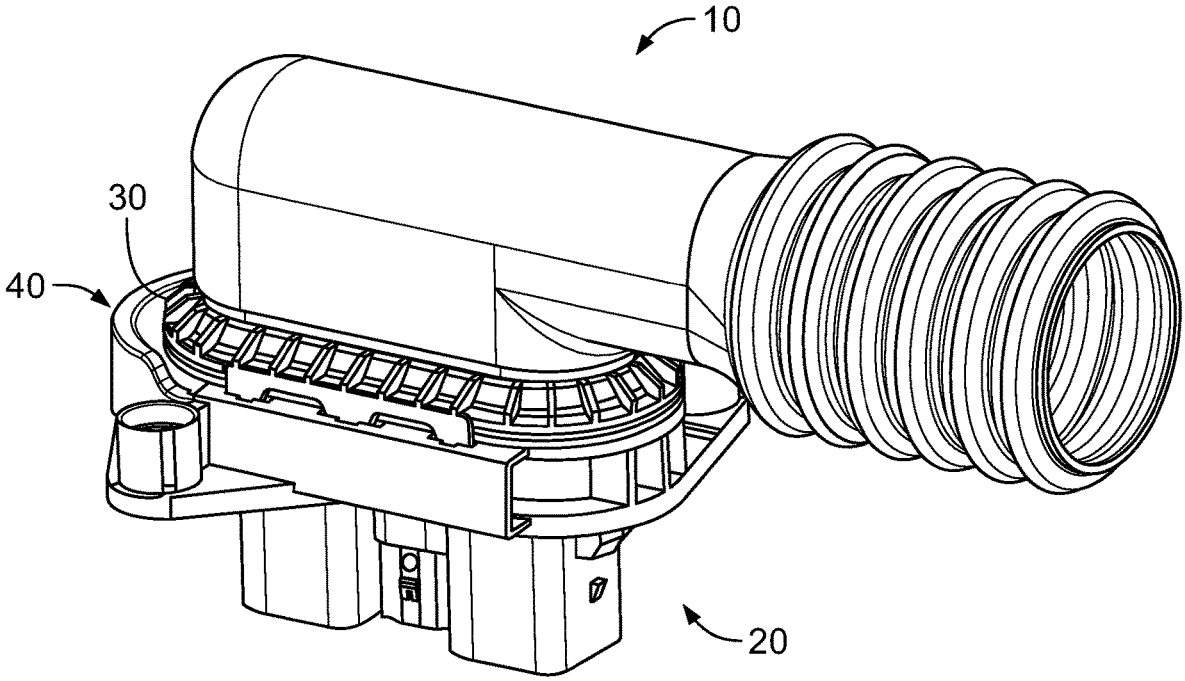
FIG. 3 is a perspective view of the connection device in an initial state in which the first sealing element engages the second sealing element.

In a second step shown in FIG. 3, the assembly of the sheath 10 and the first sealing element 30 is pushed towards connector 20 that was previously connected to the second sealing element 40. The projections 31 of the first sealing element 30 are inserted into upper grooves 22 of connector 20.

The step shown in FIG. 3 is shown in more detail in 4A and 4B. As shown in FIG. 4B, each lug 33 of projections 31 is inserted into housings 41 of second sealing element 40. The second sealing element 40 is positioned in such a way that, when first sealing element 30 together with sheath 10 is pushed towards connector 20, projections 31 of the first sealing element are inserted into housings 41. As shown in FIG. 4B, in this first step of coupling, each lug 33 is located at the entry to housings 41. To keep second sealing element 40 in the correct position for the insertion of projections 31 into housings 41, retention elements 29 of the connector 20 hold the second sealing element 40 in the correct positions during the various stages of assembly.

Figure 5A:
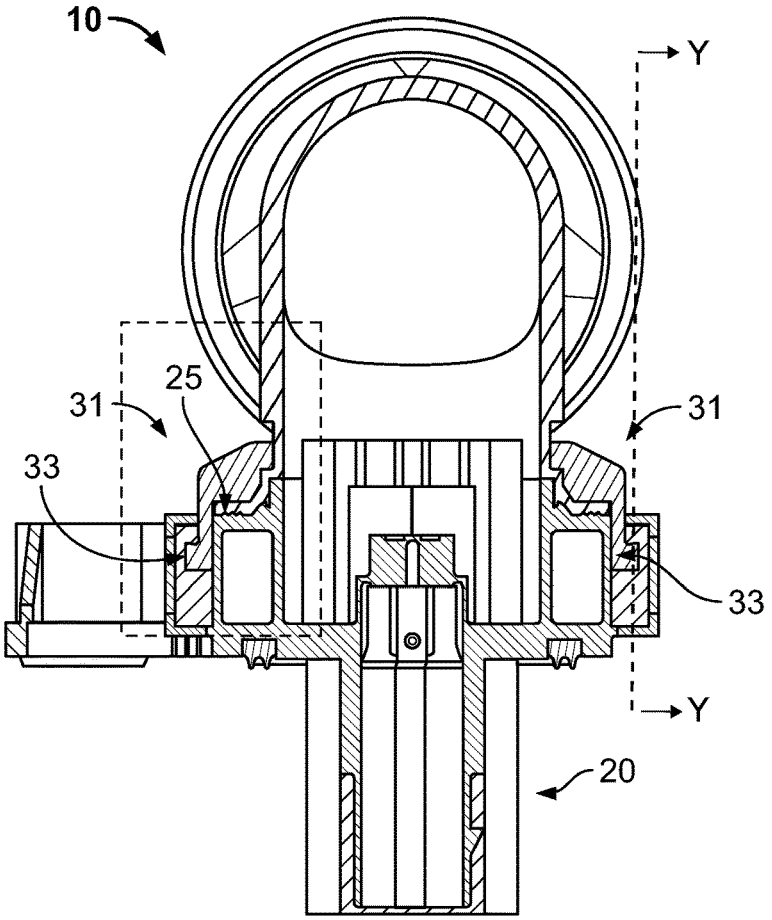
FIG. 5A is a sectional end view of the connection device in a final state.
Figure 5C:
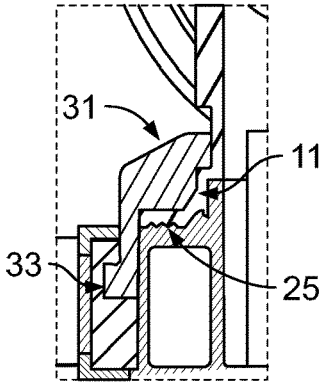
FIG. 5C is a detailed sectional end view of the connection device in the final state shown in FIG. 5A.
Figure 5B:
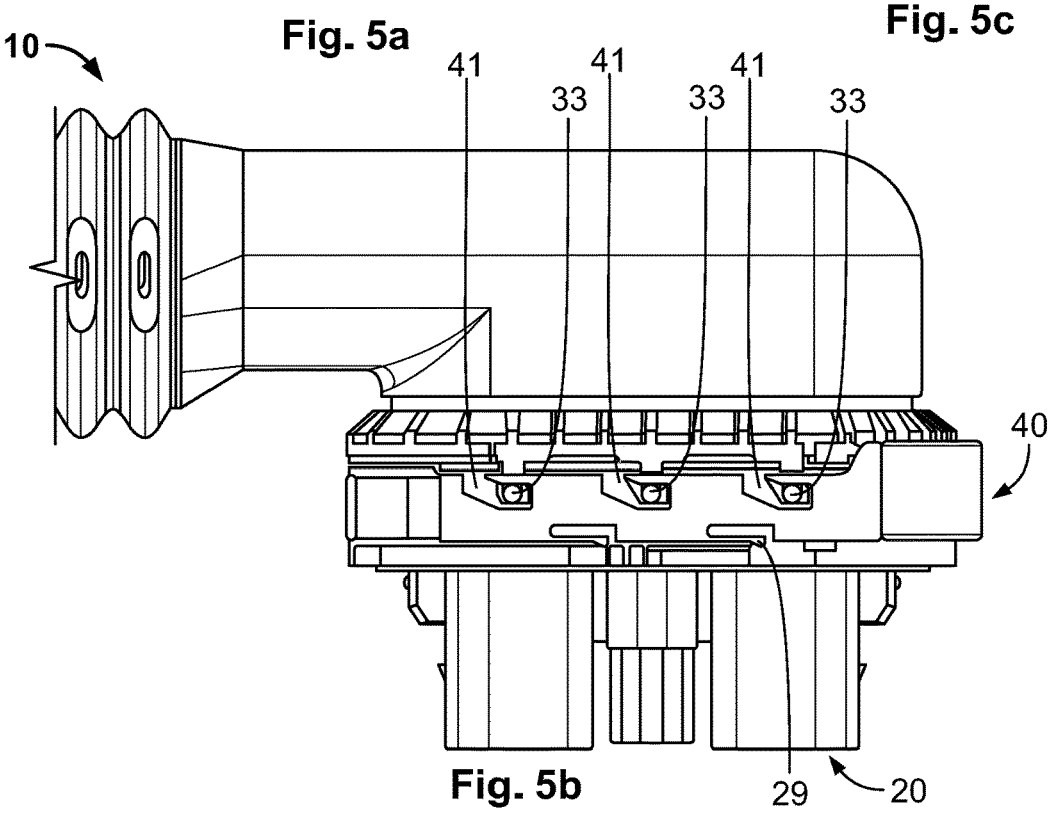
FIG. 5B is a sectional side view of the plane along the line Y-Y in FIG. 5A, depicting the connection device in the final state shown in FIG. 5*a;*

In a final state shown in FIGS. 5A and 5B, the lugs 33 of projections 31 slide into assembly slots 42 so that first sealing element 30 exerts adequate pressure on sheath 10 against connector 20. As shown in FIG. 5A, first sealing element 30 is positioned in direct contact with flange 11 of sheath 10, which is in turn in direct contact with upper surface 25 of connector 20. The pressure exerted by the first sealing element 30 is ensured by the fact that assembly slots 42 also extend along the horizontal direction, thus allowing first sealing element 30 to press against connector 20. Due to the elasticity of the materials, and in particular the elasticity of sheath 10, the first sealing element 30 can be pressed down and then press on the elements below. Lug 33 slides with respect to the assembly slot 42 by pressing second sealing element 40 so that lug 33 is able to slide into assembly slot 42.

The fact that assembly slot 42 also extends horizontally thus makes it possible to move the second sealing element 40 and the first sealing element 30 to correctly position the second sealing element 40 in relation to connector 20, which coincides precisely with the position in which lug 33 reaches the end of assembly slot 42 shown in FIG. 5B. The movement of the second sealing element 40 with respect to both the first sealing element 30 and the connector 20 is evident by comparison of FIGS. 4B and 5B.

The retention elements 29 stop the movement of second sealing element 40 with respect to connector 20 and are used to maintain the position reached by the second sealing element 40. Although it is clear that second sealing element 40 cannot slide further after lug 33 has reached the end of assembly slot 42, it is also clear that if there were no such retention elements 29, the second sealing element 40 might not return to the position shown in FIG. 4B, and a proper seal would not be guaranteed. In an embodiment, the retention elements 29 are each a snap-on element which allows second sealing element 40 to be immobilized against connector 20.

Figure 6A:
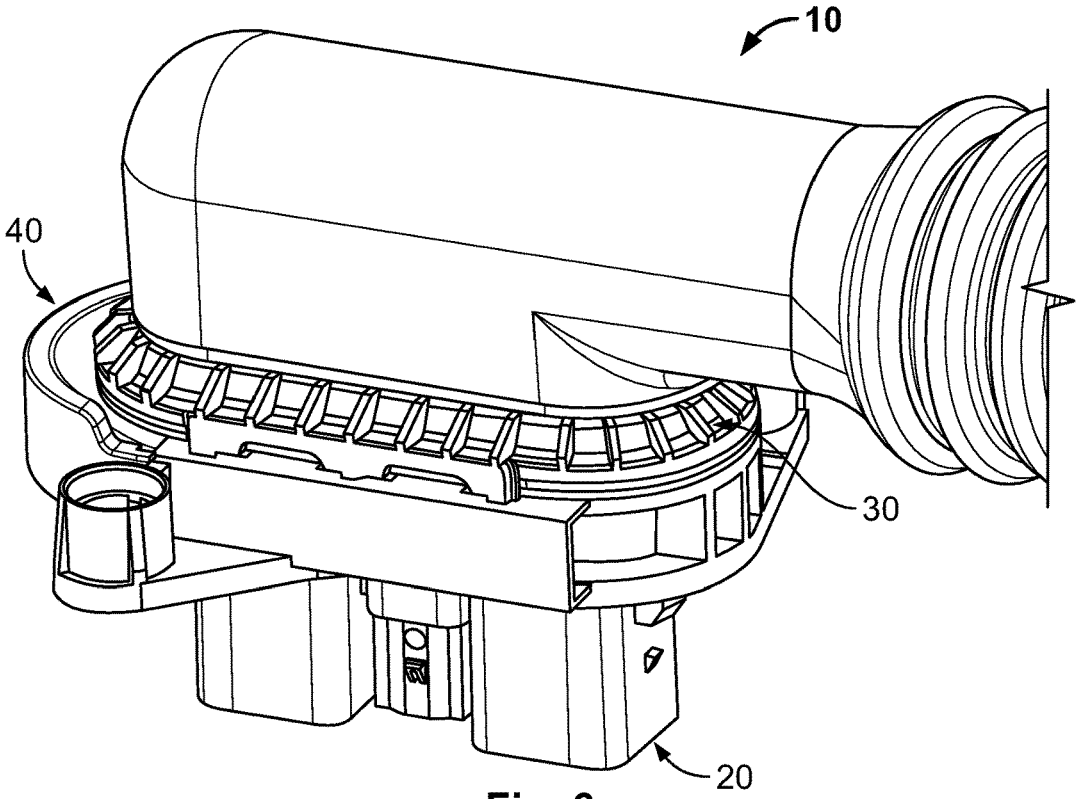
FIG. 6A is a perspective view of the connection device in the initial state shown in FIGS. 4A and 4B.
Figure 6B:
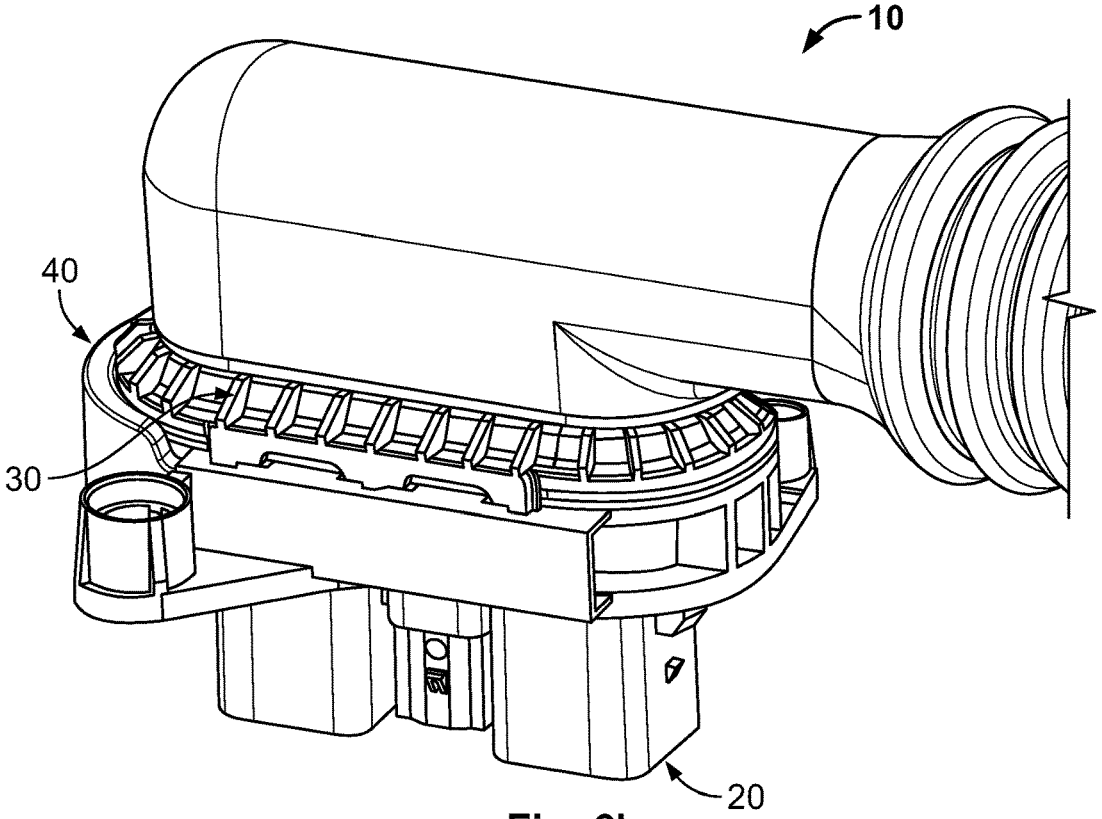
FIG. 6B is a perspective view of the connection device in the final state shown in FIGS. 5A and 5B.

The step of FIGS. 4A and 4B is shown in FIG. 6A and the step of FIGS. 5A and 5B is shown in FIG. 6B. The second sealing element 40 is pushed to the right between FIGS. 6A and 6B. Due to the pressure on the second sealing element 40, the first sealing element 30 has exerted downward pressure to press the elements below and allow the sheath 10 to push against connector 20, providing a maximum seal.

In the shown embodiment, the sheath 10 has a circular opening 14 and a substantially oval exit, however, opening 14 may be made in any shape, for example square, and the exit may have any shape, for example circular or even square. Moreover, the shown embodiment depicts the first sealing element 30 with six projections 31 in which each of these projections 31 has a lug 33, it is possible that this number of projections 31 may vary and be different from six. For example, if more grip is desired, the number of projections 31 may be increased, which strongly depends on the size of connection device 100. The larger such connection device 100, the larger the number of projections 31 of first sealing element 30.

What is claimed is:

1. A connection device, comprising:

a protection device configured to protect a cable;

a connector configured to electrically connect the connection device to an external electrical connection; and a seal connecting the protection device to the connector, the seal including a first sealing element and a second sealing element, wherein the first sealing element is mechanically connected to the protection device and the second sealing element is mechanically connected to the connector, the first sealing element engages the second sealing element to connect the protection device to the connector, wherein the second sealing element is movable with respect to the connector and the first sealing element when the first sealing element engages with the second sealing element.

2. The connection device of claim 1, wherein the first sealing element has a projection and the second sealing element has a housing.

3. The connection device of claim 2, wherein the projection is inserted into the housing to connect the protection device to the connector.

4. The connection device of claim 3, wherein the housing has an assembly slot receiving a lug of the projection.

5. The connection device of claim 4, wherein the first sealing element exerts pressure on the protection device and the connector by engagement of the lug with the assembly slot.

6. The connection device of claim 1, wherein the connector has a lateral groove receiving the second sealing element.

7. The connection device of claim 1, wherein the connector has an upper groove receiving the first sealing element.

8. The connection device of claim 1, wherein the first sealing element is formed of a plastic material and the protection device is formed of an elastic material.

9. The connection device of claim 1, wherein the connector includes a retention element holding the second sealing element with respect to the connector.

10. The connection device of claim 1, wherein the connector has an upper surface supporting a lower surface of a flange of the protection device.

11. The connection device of claim 10, wherein the upper surface of the connector has a plurality of ridges and the lower surface of the flange has a plurality of ridges corresponding to the ridges of the connector.

12. The connection device of claim 10, wherein the upper surface of the connector is a flat surface.

13. The connection device of claim 1, wherein the second sealing element is movable with respect to the connector and the first sealing element in a direction transverse to a connection direction of the connector when engaging with the first sealing element.

14. The connection device of claim 13, wherein the first sealing element has a projection and the second sealing element defines a slot receiving the projection, the slot extending in the direction transverse to the connection direction of the connector for permitting movement of the second sealing element relative to the first sealing element along the slot.

15. A connection device, comprising:

a protection device configured to protect a cable;

a connector configured to electrically connect the connection device to an external electrical connection; and a seal connecting the protection device to the connector, the seal including a first sealing element having an opening receiving the protection device and a second sealing element, wherein the first sealing element is mechanically connected to the protection device and the second sealing element is mechanically connected to the connector, the first sealing element engages the second sealing element to connect the protection device to the connector.

16. The connection device of claim 15, wherein the second sealing element is movable with respect to the connector and the first sealing element in a direction transverse to a connection direction of the connector when engaging with the first sealing element.

17. A method for connecting a protection device to a connector to form a connection device, comprising:

connecting a first sealing element to the protection device;

connecting a second sealing element to the connector; and engaging the first sealing element with the second sealing element to connect the protection device to the connector, the second sealing element moved with respect to the connector and first sealing element when engaging with the first sealing element.

18. The method of claim 17, wherein the engaging step includes inserting a projection of the first sealing element into a housing of the second sealing element.

19. The method of claim 18, wherein the projection is capable of sliding with respect to an assembly slot of the housing.

20. The method of claim 17, wherein the protection device is configured to protect a cable and the connector is configured to electrically connect the connection device to an external electrical connection.

* * * * *